United States Patent [19]

Gilderbloom

[11] 4,386,803

[45] Jun. 7, 1983

[54] MOTORIZED RECLINING CHAIR

[76] Inventor: Clarence W. Gilderbloom, 1504 New Bedford Dr., Sun City Center, Fla. 33570

[21] Appl. No.: 318,604

[22] Filed: Nov. 5, 1981

[51] Int. Cl.[3] ..... A47C 1/02

[52] U.S. Cl. ..... 297/84; 297/61; 297/83; 297/330

[58] Field of Search ..... 297/61, 84, 284, 410, 297/330, 391, 83, 85

[56] References Cited

U.S. PATENT DOCUMENTS

| | | | |
|---|---|---|---|
| 2,714,922 | 8/1955 | McKibbon et al. | 297/330 X |
| 2,760,555 | 8/1956 | Lorenz | 297/69 |
| 3,039,814 | 6/1962 | Schliephacke | 297/68 |
| 3,147,038 | 9/1964 | Barabas | 297/330 X |
| 3,476,495 | 11/1969 | Church | 297/83 |
| 3,554,599 | 1/1971 | Pietschmann | 297/284 X |
| 3,588,170 | 6/1971 | Knabusch | 297/83 |
| 3,719,391 | 3/1973 | Neri | 297/330 |
| 3,934,927 | 1/1976 | Zur | 297/284 |
| 3,934,929 | 1/1976 | Rabinowitz | 297/330 X |
| 4,007,960 | 2/1977 | Gaffney | 297/330 X |
| 4,017,118 | 4/1977 | Cawley | 297/284 |
| 4,072,342 | 2/1978 | Johnson et al. | 297/84 |
| 4,173,372 | 11/1979 | Norris | 297/330 X |
| 4,212,495 | 7/1980 | Gall | 297/84 |
| 4,222,608 | 9/1980 | Maeda | 297/410 |
| 4,270,796 | 6/1981 | Preston | 297/84 X |
| 4,285,541 | 8/1981 | Onishi | 297/84 |

FOREIGN PATENT DOCUMENTS

| | | | |
|---|---|---|---|
| 1261625 | 2/1968 | Fed. Rep. of Germany | 297/61 |

*Primary Examiner*—James T. McCall

*Attorney, Agent, or Firm*—Duckworth, Allen, Dyer & Pettis

[57] ABSTRACT

In a motorized reclining chair including a chair frame having arms the improvement comprising the unique mounting of a movable back and seat portion, an ottoman and a headrest thereon, whereby totally independent adjustment of those elements may be accomplished within predetermined limits by the user. Movement of the elements of the improved reclining chair is accomplished by selectively actuating any combination of three electric motors provided for this purpose. By virtue of this construction the user of the chair may repose in any of a great variety of positions varying from a substantially erect, seated position to a fully reclined, substantially supine position.

10 Claims, 7 Drawing Figures

FIG. 1
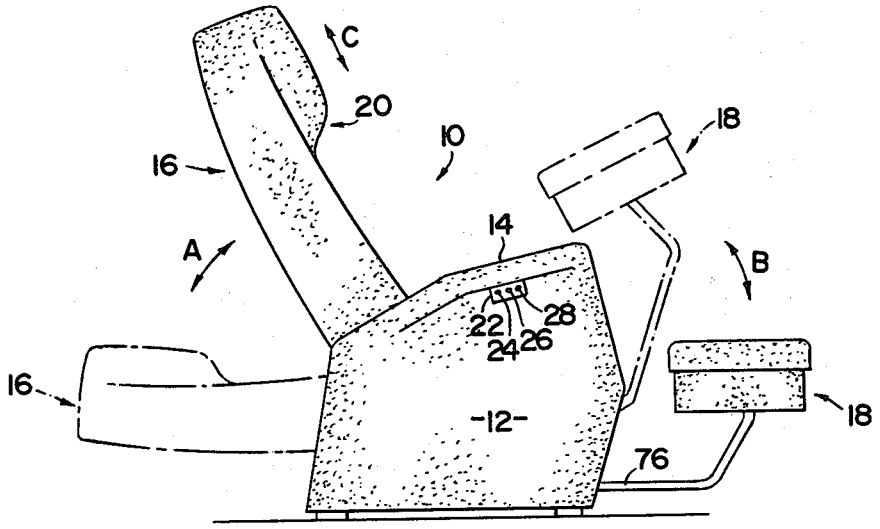
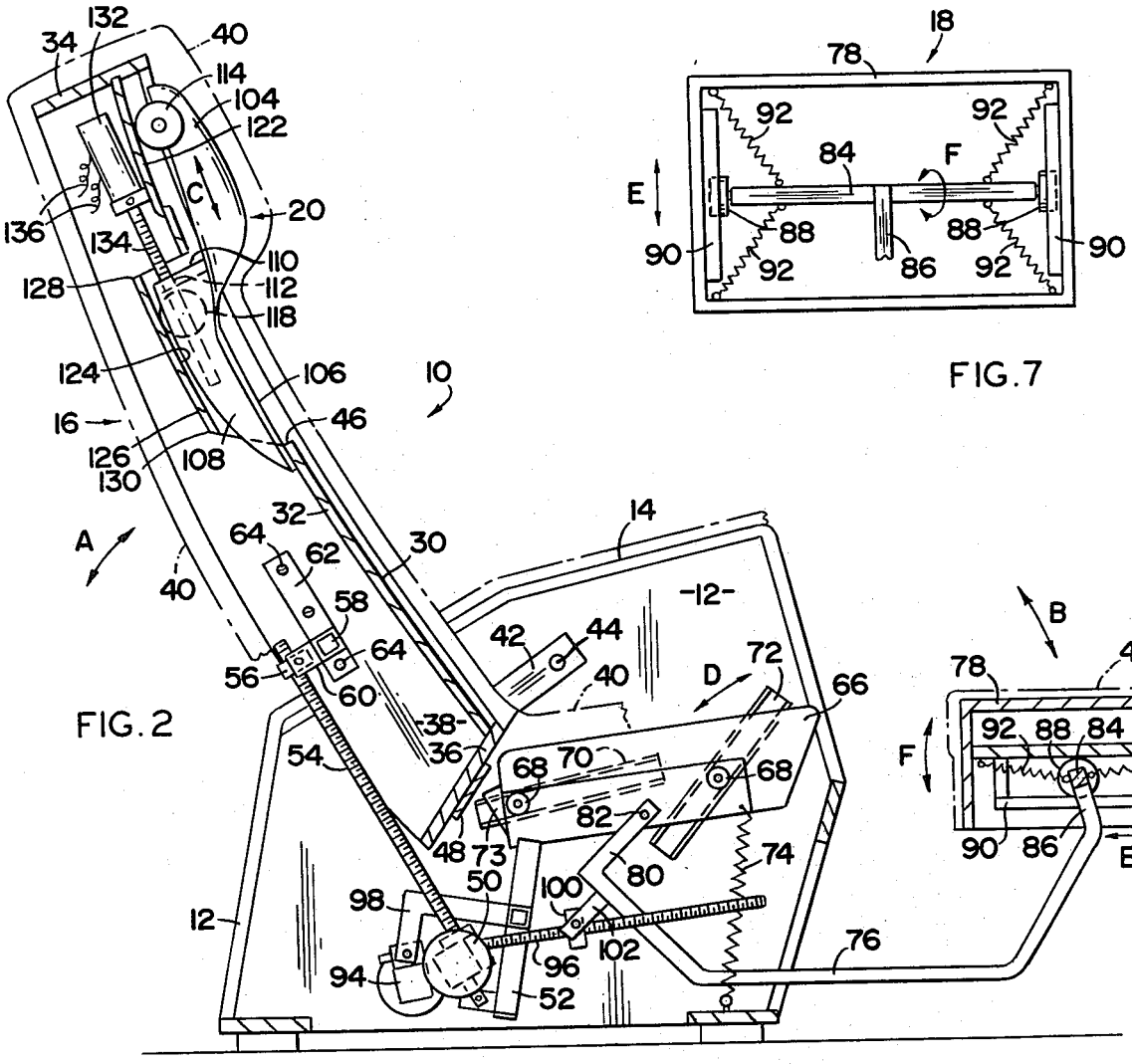
FIG. 7
FIG. 2

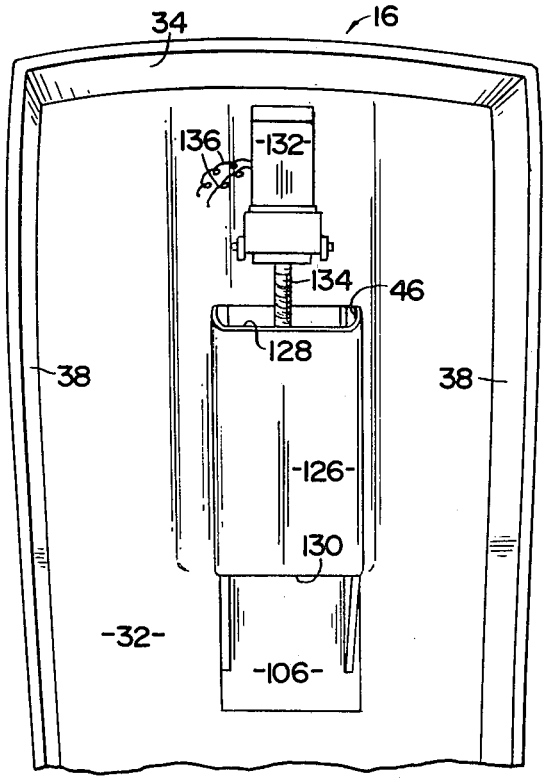
FIG. 3
FIG. 4
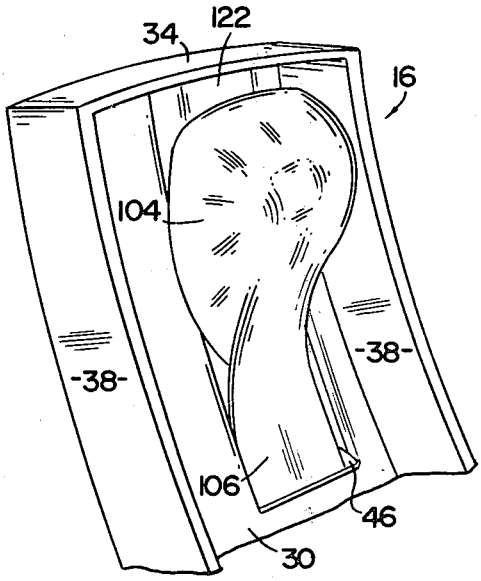
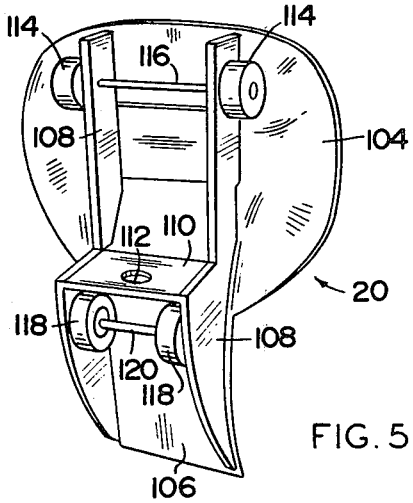
FIG. 5
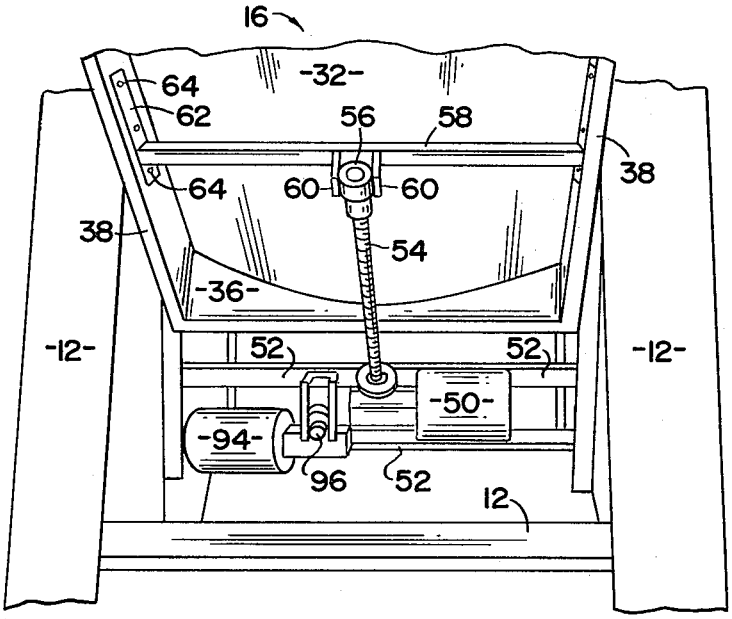
FIG. 6

MOTORIZED RECLINING CHAIR

BACKGROUND OF THE INVENTION

1. Field of the Invention

The present invention concerns improvements in motorized reclining chairs. More specifically, the improved motorized reclining chair of this invention comprises means whereby a movable seat and back, a movable ottoman, and a movable headrest may be independently adjusted within predetermined limits in accord with the desires of the user of the chair.

2. Description of the Prior Art

Numerous reclining chair constructions are, of course, well known in the prior art. While many of these chairs find their primary utility in individual, private use as, for example, in homes, reclining chair constructions are also well known in the medical and dental arts for their use in presenting specific portions of a patient's body for examination and/or treatment.

Perhaps the majority of such prior art reclining chairs utilize entirely mechanical linkage structures between the chair's back and seat portions and its frame to permit a reclining function. Very often, such prior art reclining chair also include similar mechanical linkage between the frame and a leg rest member. The following U.S. Pat. Nos. are illustrative of such prior art devices: 2,760,555 (Re. 24,760); 3,039,814; and 3,845,545.

U.S. Pat. No. 4,072,342, also discloses a mechanical-type reclining chair wherein the main chair frame is movably mounted on a support track to permit reclining of the chair even when positioned substantially adjacent a wall. In all of the prior art constructions identified above, it should be noted that the reclining motion of these chairs is substantially unitary. That is to say, the reclining motion is accomplished by the user exerting a force against the back of the chair. As the back moves rearwardly, mechanical linkage automatically provides for simultaneous movement of the back, the seat, and the leg rest if provided. These prior art devices do not include any means for independently positioning either of the movable elements.

In more recent years, the state of the art in reclining chair constructions had advanced to the point of including motors for adjusting the position of the chair automatically, without the necessity of the user applying mechanical force to any of the chair's elements. For example, U.S. Pat. No. 3,476,495, discloses a reclining chair wherein the movement of the chair back, and therefore the seat and leg rest is accomplished by means of an electric motor which turns a jack screw arrangement to raise and lower the back, alternatively. By virtue of additional, purely mechanical linkage, movement of the back automatically results in predetermined movement of both the seat and the leg rest. U.S. Pat. No. 3,588,170, teaches a motorized reclining chair having two separate and independently-operable motors. A first motor controls movement of both the chair back and seat with respect to the frame. A second motor controls movement of the leg rest with respect to the frame. As with the prior art devices previously discussed, this patent also teaches a fixed mechanical linkage between the chair back and the chair seat so that as the back reclines, the seat moves forwardly. An adjustable dental chair is taught in U.S. Pat. No. 3,934,929. A single electric motor controls the relative movement of the chair back, the chair seat, and the leg rest in a unitary fashion.

From the above state of the prior art it can be seen that while motors have been substituted for mechanical force exerted by the chair's occupant, very little has been accomplished with regard to interrelationships between the chair back and the frame, the chair back and the seat, the seat and the frame, nor the leg rest and the frame. Furthermore, none of these prior art devices teach any separately adjustable head supporting means. The absence of an adjustable head support, or headrest, is of note for the reason that it is well known that when a chair reclines, not only might the occupant's head position shift, but most certainly his center of gravity will change. It is therefore apparent that there is a great need in the art for an improved reclining chair construction wherein relative movement of the chair back, the chair seat, the leg rest, and the headrest are independently adjustable. Furthermore, any interconnection between moving elements either to the frame or each other, should be arranged so as to provide maximum support and minimum stress to the occupant's body.

While the foregoing features of utility should be obtained, it must also be remembered that the complete reclining chair will be used as an article of furniture in homes and offices. Accordingly, the utilitarian structure of the chair must be arranged so as to permit the application of standard padding and upholstery material to provide an aesthetically pleasing finished product. Furthermore, since motors will be utilized to position the various elements of the chair, it is further desirable that the chair be constructed in a fashion which permits ready accessability to the motors, as for maintenance, adjustment and repair.

SUMMARY OF THE INVENTION

The present invention concerns improvements in the construction of motorized reclining chairs. Inasmuch as the invention basically comprises means for movably mounting various chair elements onto a standard frame, as well as the means whereby movement of those elements is regulted in predetermined fashion, the following summary will be given with particular regard to the chair's "skeleton" comprising the chair back, seat, ottoman, headrest, motors, and their interrelationships with respect to each other and the standard chair frame. It is, however, to be remembered that standard padding and upholstery material will be added to the completed chassis in normal fashion to provide an attractive finished product.

The chair frame of the improved motorized reclining chair is of standard construction including a pair of arms along each side thereof. A chair back is pivotally connected to the frame by a pair of back mounting brackets, with one bracket on each side of the back adjacent the frame. The pivotal connection between the back and the chair frame is offset. That is to say, a line connecting the two oppositely disposed pivot points would not lie along any plane defined by the seat back. Rather, the pivot points are relatively forward of the chair back for reasons of comfort and support which will be discussed hereinafter. Movement of the chair back from its relatively upright position to a substantially horizontal position with respect to the bottom of the chair frame is accomplished by actuation of a first motor means. The first motor means preferably comprises an electric motor which is mounted on the chair frame and operatively connected to a threaded shaft extending therefrom. The motor is reversible so that the shaft may be turned, selectively, in both clockwise and counterclockwise directions. The free end of the threaded shaft, opposite from the motor, is received in a chair back bracket disposed on the chair back and including a threaded aperture formed therein to which the threaded shaft is mated. Accordingly, actuation of the first motor means to rotate the threaded shaft will result in corresponding movement, either up or down depending upon the direction of rotation, of the bracket and the chair back to which the bracket is attached. For convenience in operation, a three position switch (up-neutral-down) may be positioned on one of the arms of the chair frame.

The improved chair further comprises a seat member movably mounted on the frame wherein movement of the seat member is primarily controlled by movement of the seat back. A corresponding pair of support rollers are disposed on each side of the seat member, and a corresponding pair of roller guides are fixed to the chair frame. Each one of the support rollers is received within a corresponding one of the roller guides so as to control and regulate movement of the seat in predetermined fashion with respect to the chair frame.

A first pair of roller guides are mounted on opposite sides of the frame and toward the rear of the frame at an upwardly inclined angle of about 13° with respect to horizontal. A second pair of roller guides are fixed to the frame forwardly of the first pair and are disposed at an upwardly inclined angle of about 50° with respect to horizontal. By virtue of this construction, and as will be set forth in greater detail below, movement of the seat member is in a relatively forward and upward direction to provide pelvic tilt and thereby relieve lumbar stresses.

Actual movement of the seat member in its forward and upward direction is accomplished in response to predetermined lowering, or reclining movement of the chair back. Seat engaging means basically comprising a pair of block members are mounted on each side of the bottom of the chair back so as to engage a corresponding pair of wedge-shaped members fixed to the seat member upon the back's being lowered a predetermined distance. Once the seat engaging means abuts the seat wedge member, any further lowering of the chair back will result in corresponding forward and upward motion of the seat member as its support rollers travel along the path defined by the roller guides. As the chair back is raised, return of the seat member to its normal, or neutral, position toward the bottom of the frame is accomplished not only by the weight of the occupant, but also by the normal force of a first biasing means disposed in interconnecting relation between the seat member and the chair frame.

At this point it should be noted that unlike most prior art devices, lowering of the chair back of this invention does not immediately cause any movement of the seat member. Only after the chair back has been lowered a predetermined distance will the seat member begin to move. Then, because of the arrangement and disposition of the roller guides along which the seat member moves, the occupant's lower torso and pelvis will be smoothly moved forward and raised so as to minimize any forces of compression, tension, or twist on the spine. These desirable results are further enhanced by virtue of the fact that the pivot point of the chair back is offset so as to be approximately in line with the occupant's hip-joints.

The improved reclining chair further includes an ottoman member which is pivotally attached to the frame so as to be movable in either an up or down direction, said movement being occasioned by a second motor means. The ottoman member comprises an ottoman support arm, a first end of which is pivotally connected to the frame. A footrest is movably mounted on the second end of the support arm. The second motor means is operatively mounted in interconnecting relation between the frame and the support arm in substantially the same fashion as set forth above with regard to the first motor means. Accordingly, depending upon the direction of rotation of the threaded shaft extending from the second motor means, the ottoman member will move up or down. Particular attention is invited to the unique method and construction for movably mounting the footrest onto the second end of the ottoman support arm.

A guide bar is fixed in substantially transverse relationship to the second end of the support arm, and the guide bar includes an ottoman roller at each end thereof. The footrest may be, for example, of relatively standard rectangular configuration. A pair of oppositely disposed tracks are mounted on the footrest, and each one of the tracks is in receiving relation to a corresponding one of the ottoman rollers. Therefore, the footrest is free not only to pivot around the guide bar, but also to reciprocate back and forth therealong as the rollers traverse their corresponding tracks. Thus, it can be seen that almost limitless dispositions of the leg rest may be achieved so as to support the occupant's lower extremeties in a most comfortable fashion. In order to maintain the foot rest in a relatively stable position with respect to the support arm, without limiting its mobility, the ottoman member further comprises a plurality of second biasing means disposed in interconnecting relation between the guide bar and the footrest. The force of each of the biasing means is balanced so as to urge the footrest toward a centered, or neutral, position with respect to the guide bar.

Finally, the improved reclining chair of this invention further comprises headrest means movably mounted on the chair back. The movable headrest is provided in recognition of the fact that as the back is lowered and raised the occupant's center of gravity will change, necessarily resulting in the application of changing forces of tension, compression, and/or twisting to the cervical vertabrae. Adverse effects of these forces may be significantly relieved, if not entirely overcome, by repositioning the movable headrest.

The headrest means comprises a contoured outer portion and an elongated inner portion. An aperture is formed through the chair back, and the inner portion of the headrest means extends therethrough, whereby the contoured outer portion is disposed on a first surface of the back, and the elongated inner portion is disposed a second surface of the back behind the aperture. Movement of the headrest in either up or down directions is accomplished by a third motor means which is operatively mounted on the chair back in interconnecting relation between the back and the elongated inner portion of the headrest. The construction and operation of this third motor means is substantially in accord with that of the first and second motor means. In order to provide for smooth movement of the headrest, the headrest further comprises first headrest roller means movably attached to the outer portion in engaging relation to the first surface of the chair back. Second headrest roller means are movably attached to the inner portion of the headrest in engaging relation to the chair back second surface. Accordingly, the headrest means actually rolls up and down the chair back, dependent upon the direction in which the threaded shaft extending from the third motor means is turned. It is also to be understood that operating switches for both the second and third motor means may be mounted on either of the chair arms as previously indicated with specific regard to the control switch for the first motor means.

It is, of course, to be understood that each of the first, second and third motor means must be disposed on the improved reclining chair not only so that they do not interfere with the chair's operation, but also so that they will be readily accessible for maintenance, adjustment and repair. Having thus set forth the basic construction for the chassis, it is also to be understood that the chair back, the seat member, ottoman member, and the headrest means, as well as exposed portions of the frame and arms, will be padded and upholstered in standard fashion.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 1 is a side elevation view of the motorized reclining chair of this invention wherein relative movement of the chair back and the ottoman member is shown in broken lines.

FIG. 2 is a sectional view of the improved chair showing interior detail and relative movement of the chair elements.

FIG. 3 is an elevational view of a portion of the chair back showing the third motor means and a portion of the headrest.

FIG. 4 is a perspective view of a portion of the chair back illustrating the contoured surface of the headrest.

FIG. 5 is a perspective view of the headrest illustrating the first and second headrest roller means.

FIG. 6 is a fragmentary elevational view of the back of the improved reclining chair illustrating the first motor means and its disposition in interconnecting relation between the chair frame and the chair back.

FIG. 7 is a bottom plan view of the ottoman member.

Similar reference characters refer to similar parts throughout the several views of the drawings.

DETAILED DESCRIPTION

The improved motorized reclining chair of the present invention is generally indicated as 10 in the views of FIGS. 1 and 2. With particular regard to the view of FIG. 1, it can be seen that chair 10 is of relatively standard appearance including an upholstered frame 12 having arms 14, and a chair back generally indicated at 16, an ottoman member generally indicated at 18, and headrest means generally indicated at 20. Directional arrow A represents raising and lowering chair back 16. In similar fashion, directional arrow B and the corresponding broken line illustration show raising and lowering of ottoman member 18. Finally, directional arrow C presents the up and down motion of headrest means 20. Also visible in the view of FIG. 1 is a control panel 22 including first, second and third switches 24, 26 and 28, respectively, mounted thereon. The function and operation of switches 24, 26 and 28 will be discussed in greater detail hereinafter. However, it should be noted at this point that all three switches 24, 26 and 28 need not be installed on a single control panel 22. Alternatively, any one or more of said switches may be positioned on a separate control panel as, for example, on the other side of chair 10. Attention is next invited to the view of FIG. 2 wherein structural details of this preferred embodiment for chair 10 may be more easily seen.

The view of FIG. 2 shows the reclining chair 10 of this invention with substantial portions of the upholstered frame 12 removed. Chair back 16 in its overall appearance is of relatively standard, substantially rectangular construction. Back 16 includes a front 30, a back 32, a top 34, and a bottom 36. Chair back side members 38 (only one of which is visible in the view of FIG. 2), and the exposed portions of chair back 16 are upholstered as indicated by reference numeral 40.

Chair back 16 is pivotally connected to frame 12 by a pair of oppositely disposed brackets 42 (only one of which is visible in the view of FIG. 2). One end (not shown) of each of the brackets 42 is fixed to a corresponding side member 38, and the other end of each of the brackets 42 is pivotally connected to frame 12 as by pivot pin 44. Thus, as clearly seen in the view of FIG. 2, the pivot point for back 16 is relatively forward of front 30. Thus a line connecting the two pivot pins 44 would not lie along the plane defined by front 30. Rather the line would approximate the position of the hip joints of an occupant of the chair. The importance of this feature of construction will be further discussed below. Chair back 16 further comprises an aperture 46 formed therethrough and seat engaging means 48 disposed on bottom 36.

Turning now to the view of FIG. 6, first motor means 50, comprising a reversible electric motor, can be seen. First motor means 50 is operatively mounted on motor mounts 52 which are fixed to frame 12, and thus first motor means 50 interconnects frame 12 with chair back 16. A first threaded shaft 54 may be driven in either clockwise or counterclockwise rotation by first motor means 50, and threaded shaft 54 is received by a correspondingly threaded first collar 56 which is fixedly disposed across back 32 of chair back 16 as by brace 58. Brace 58 may be fixed to first collar 56 as by welding along legs 60, and brace 58 may be secured to chair back 16 as by mounting arms 62 and screws 64. The direction of rotation of first threaded shaft 54 is determined by first motor means 50, which in turn is operated by first switch 24. Accordingly, when first threaded shaft 54 is turned in a clockwise direction, chair back 16 will recline. When first threaded shaft 54 is turned in a counterclockwise direction, chair back 16 will be raised.

A seat member 66 may be seen in the view of FIG. 2. Seat member 66 is movably mounted on frame 12 as indicated by directional arrow D, and would be upholstered as indicated at 40. Each side of seat member 66 adjacent frame 12 includes a corresponding pair of support rollers 68. A corresponding pair of roller guides 70 and 72 are fixed to frame 12 and receive a corresponding one of the support rollers 68 therein. As clearly seen in the view of FIG. 2, both of the roller guides 70 and 72 are inclined upwardly with respect to horizontal. It has been determined that roller guide 70 may be inclined at an angle of about 13°, while roller guide 72 may be inclined at an angle of about 50°. Seat member 66 is free to move within the limits of the roller guides 70 and 72 in a forward-upward direction, and back, as indicated by the directional arrow D.

The motive force necessary to move seat member 66 forwardly and upwardly is provided by the abutting relation between seat engaging means 48 and seat wedge members 73 once chair back has been reclined, or lowered, sufficiently to cause the engaging means 48 to bear against seat wedge members 73. Seat member 66 will move toward its normal position in the direction of the bottom of frame 12 as chair back 16 is raised. This rearward and downward motion of seat member 66 is accomplished not only by the weight of the chair's occupant, but also by the normal biasing force of first biasing means 74 disposed in interconnecting relation between seat member 66 and frame 12.

It is, of course, obvious that a frictional abutment takes place between seat engaging means 48 and seat wedge members 73. Accordingly, it is preferable that seat engaging means 48 and seat wedge members 73 be formed from a friction-reducing material such as, for example, nylon.

From the foregoing description of chair back 16 and seat member 66, it can be seen that there is a predetermined relationship between movement of chair back 16 and seat member 66. As chair back 16 reclines farther toward a horizontal position, seat member 66 moves farther forward and up. This relative movement, in combination with the offset pivotal attachment of chair back 16 to frame 12 as set forth above, cooperate to reduce undesirable stress on the occupant's back, pelvis, and thighs.

As also best seen in the view of FIG. 2, ottoman member 18 comprises an ottoman support arm 76 and a footrest 78. The exposed surface of footrest 78 would normally be upholstered as indicated by reference numeral 40. A first end 80 of ottoman support arm 76 is pivotally connected to frame 12 as by ottoman pivot pin 82. As best seen in the view of FIG. 7, a guide bar 84 is fixed in substantially transverse relation to second end 86 of support arm 76. An ottoman roller 88 is movably disposed at each end of guide bar 84. Each of the ottoman rollers 88 are received within a corresponding track 90 formed on footrest 78 so that footrest 78 may roll back and forth along track 90 as indicated by directional arrows E, and may also pivot about guide bar 84 as indicated by directional arrows F. In order to maintain the position of the footrest 78 in the substantially neutral position as shown in FIGS. 1, 2 and 7, a plurality of second biasing means 92 are disposed in interconnecting relation between guide bar 84 and footrest 78. Second biasing means 92 are balanced so that relatively little external force is required from the occupant in order to reposition footrest 78.

The movement of ottoman member 18 in up and down directions as indicated by arrow B is governed by the operation of second motor means 94. Second motor means 94 is substantially identical in its construction and operation as first motor means 50. Second motor means 94 also includes a second threaded shaft 96 whereby second motor means 94 is operatively disposed in interconnecting relation between frame 12 and support arm 76 of ottoman member 18. Second motor means 94 is fixed to frame 12 by its brace 98 which is in turn fixed to motor mounts 52. Second threaded shaft 96 is operatively connected to ottoman member 18 as by coupling second threaded shaft 96 with its corresponding second collar 100 which is fixed to ottoman support arm 76 by collar brace 102. The clockwise or counterclockwise rotation of second threaded shaft 96 is accomplished by second motor means 94 in response to the placement of second switch 26.

Thus, counterclockwise rotation of second threaded shaft 96 will cause ottoman member 18 to rise, and clockwise rotation of shaft 96 will cause ottoman member 18 to lower. It is, of course, to be remembered that movement of ottoman member 18 is completely independent of any other chair function.

Attention is next invited to a detailed description of the unique headrest means 20 of the present invention. As perhaps best seen in the view of FIGS. 4 and 5, headrest means 20 comprises a contoured outer portion 104 and an elongated inner portion 106. Headrest means 20 is movably disposed on chair back 16 by inserting elongated inner portion 106 through aperture 46 so that contoured outer portion 104 is substantially adjacent front 30 and elongated inner portion 106 is substantially adjacent back 32. As best seen in the view of FIG. 5, headrest means 20 further comprises a carriage assembly including side walls 108 and cross member 110 including a headrest aperture 112 formed therethrough.

First headrest roller means comprising a pair of first rollers 114 joined by first axle 116 is mounted on the outside of side walls 108 behind contoured outer portion 104. Second headrest roller means comprising a pair of second rollers 118 joined by second axle 120 is mounted inside side walls 108 below cross member 110 and behind elongated inner portion 106.

Referring now to the view of FIG. 2, it can be seen that first rollers 114 will ride along a first surface 122 defined by a depression formed in front 30 of chair back 16. Second rollers 118 will ride along a second surface 124 defined by the interior of a box-like second roller means guide 126 formed on back 32 of chair back 16 just below aperture 46. As clearly seen in the views of FIGS. 2 and 3, second roller means guide 126 is open at both the top 128 and the bottom 130.

A third motor means 132 is operatively mounted in interconnecting relation between chair back 16 and headrest means 20. The construction and operation of third motor means 132 is substantially the same as that previously set forth with regard to first motor means 50 and second motor means 94. A third threaded shaft 134 may be turned in either clockwise or counterclockwise directions by third motor means 132, and third threaded shaft 134 is operatively connected to headrest 20 by inserting shaft 134 into correspondingly threaded aperture 112. In a fashion analogous to that already described, wires 136 lead to third switch 28 whereby the direction and rotation provided by third motor means 132 may be controlled by the chair's occupant. Rotation of third threaded shaft 134 in a clockwise direction will result in upward movement of headrest means 20, and counterclockwise rotation of shaft 134 will result in corresponding downward movement of headrest means 20. Also as previously stated with regard to first motor means 50 and second motor means 94, it is to be understood that the operation of this third motor means 132, and thus the movement of headrest means 20, is completely independently of any other chair function.

Having thus set forth a detailed description of the preferred embodiment of the motorized reclining chair of this invention so that a person skilled in the art may understand its construction, attention is finally invited to the following general comments concerning the chair's use and utility. The improved chair of this invention provides virtually complete support for the entire body of an occupant, from head to toe, in an almost infinitely variable number of sitting and reclining positions. Primarily because of the independent operation provided for each of the motor means 50, 94 and 132, and because of the unique pivotal connection of the chair back 16 and its operation of seat member 66, the body of a chair occupant can be supported in such a way that minimal pressure is placed upon any major artery or vein, resulting in improved circulation. Body weight can be distributed so that no part of the occupant's body will experience unpleasant external pressures. Because of the unique provision of a movable headrest means 20, the neck and shoulder muscles can be especially relieved of the constant tension normally required to hold the head up, regardless of the position of chair back 16, seat member 66, or ottoman member 18. Normal gravitational pressures on the diaphragm and lungs can be relieved to promote easier breathing. Occupant's spine is supported in a fashion to relieve significantly the forces of compression, tension and/or twisting normally inherent in current reclining chair constructions. Obviously, then, the reclining chair of this invention is not only comfortable and durable, but also may provide positive therapeutic benefits.

The offset pivotal mounting of chair back 16 to frame 12 is particularly noteworthy. By virtue of this construction bottom 36 swings forwardly as back 16 reclines. This motion shifts the occupant's trunk forward before seat member 66 begins to move. Then, when back 16 engages seat 66, all portions of occupant's body move in harmony, thereby eliminating the feeling of "skin pull" normally experienced in current reclining chair constructions.

It will thus be seen that the objects set forth above, among those made apparent from the preceeding description, are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. In a motorized reclining chair including a chair frame having arms the improvement comprising: a chair back pivotally connected to the frame wherein said pivotal connection between said back and the frame is offset with respect to the plane defined by said back; first motor means operatively mounted in interconnecting relation between the frame and said back; a seat member movably mounted on the frame; seat engaging means mounted on one end of said back in abutting relation to said seat member, whereby predetermined movement of said back by said first motor means will cause said seat engaging means to move said seat member; an ottoman member pivotally connected to the frame; second motor means operatively mounted in interconnecting relation between the frame and said ottoman member; headrest means movably mounted on said back; and third motor means operatively mounted on said back in interconnecting relation between said back and said headrest means, whereby each of said chair back, said ottoman member and said headrest may be selectively positioned by its corresponding one of said first, second and third motor means independently of the others.

2. The improved motorized reclining chair of claim 1 wherein said offset pivotal connection between said back and the frame lies substantially along a line defined by the hip joints of an occupant of the chair.

3. The improved motorized reclining chair of claim 1 wherein said seat member comprises a corresponding pair of support rollers disposed on each side thereof adjacent the frame, and a corresponding pair of roller guides fixed to the frame, each one of said pair receiving a corresponding one of said rollers therein, whereby said seat member may move with respect to the frame in predetermined fashion.

4. The improved motorized reclining chair of claim 3 wherein said seat member further comprises first biasing means disposed in interconnecting relation between said seat member and the frame to urge said seat member toward the bottom of the frame normally.

5. The improved motorized reclining chair of claim 1 wherein said ottoman member comprises an ottoman support arm, a first end of said arm being pivotally connected to the frame; and a foot rest movably mounted on a second end of said support arm, said second motor means being operatively mounted in interconnecting relation between the frame and said support arm.

6. The improved motorized reclining chair of claim 5 wherein said support arm further comprises a guide bar fixed in substantially transverse relation to said second end and including an ottoman roller at each end of said guide bar; said foot rest including a pair of oppositely disposed tracks mounted thereon, each one of said tracks being in receiving relation to a corresponding one of said ottoman rollers, whereby said foot rest may reciprocate and pivot with respect to said support arm.

7. The improved motorized reclining chair of claim 6 further comprising a plurality of second biasing means disposed in interconnecting relation between said guide bar and said foot rest, the biasing force of each of said second biasing means being balanced to urge said footrest toward a neutral position normally.

8. The improved motorized reclining chair of claim 1 wherein said back comprises an aperture formed therethrough in receiving relation to at least a portion of said headrest means; said headrest means comprising a contoured outer portion and an elongated inner portion, said inner portion extending through said aperture, whereby said contoured outer portion is disposed on a first surface of said back and said elongated inner portion is disposed on a second surface of said back.

9. The improved motorized reclining chair of claim 8 wherein said third motor means is operatively mounted on said back in interconnecting relation between said back and said elongated inner portion, whereby said headrest means may be moved with respect to said back.

10. The improved motorized reclining chair of claim 8 wherein said headrest means further comprises first headrest roller means movably attached to said outer portion in engaging relation to said first surface, and second headrest roller means movably attached to said inner portion in engaging relation to said second surface.

* * * * *